US006295669B1

(12) United States Patent
Saus

(10) Patent No.: US 6,295,669 B1
(45) Date of Patent: Oct. 2, 2001

(54) FOLDING, DISMOUNTABLE AND TELESCOPIC STRUCTURE

(76) Inventor: Jose Lopez Saus, Muntaner 520 - 3o-3a, 08022 Barcelona (ES)

( * ) Notice: Subject to any disclaimer, the term of this patent is extended or adjusted under 35 U.S.C. 154(b) by 0 days.

(21) Appl. No.: 09/560,831

(22) Filed: Apr. 28, 2000

(30) Foreign Application Priority Data

Apr. 29, 1999 (ES) ..... 9900891

(51) Int. Cl.[7] ..... A47C 17/64; A47C 17/76; A47C 19/12

(52) U.S. Cl. ..... 5/116; 5/111; 5/114; 5/176.1; 5/312; 108/115; 248/346.3

(58) Field of Search ..... 5/174, 504.1, 111, 5/114, 112, 116, 117, 312, 176.1; 248/346.3; 108/115, 163; 297/42

(56) References Cited

U.S. PATENT DOCUMENTS

| | | | | |
|---|---|---|---|---|
| 752,941 | * | 2/1904 | Wykert | 5/117 |
| 1,170,977 | | 2/1916 | König . | |
| 1,569,728 | * | 1/1926 | Douglas et al. | 5/116 |
| 2,326,461 | | 8/1943 | Howe . | |
| 3,037,215 | | 6/1962 | Pile | 5/111 |
| 3,067,975 | | 12/1962 | Wilcox . | |
| 3,359,576 | | 12/1967 | Pile . | |
| 3,878,797 | | 4/1975 | Patterson . | |
| 4,333,638 | | 6/1982 | Gillotti . | |
| 4,354,437 | | 10/1982 | Logan . | |
| 4,575,975 | | 3/1986 | Eisenberg . | |
| 4,658,735 | | 4/1987 | Holton . | |
| 4,833,998 | | 5/1989 | Everett et al. . | |
| 4,838,179 | | 6/1989 | Bing . | |
| 4,927,128 | | 5/1990 | O'Brian . | |
| 4,943,041 | | 7/1990 | Romein . | |
| 5,009,170 | | 4/1991 | Spehar . | |
| 5,177,823 | | 1/1993 | Riach . | |
| 5,335,676 | | 8/1994 | O'Brien . | |
| 5,524,555 | | 6/1996 | Fanuzzi . | |
| 5,606,755 | | 3/1997 | Romein . | |
| 5,676,062 | | 10/1997 | Lloyd . | |
| 5,699,565 | | 12/1997 | Petterborg | 5/504.1 |
| 5,762,402 | | 6/1998 | Gillotti . | |
| 5,769,005 | | 6/1998 | Haynes . | |
| 5,913,271 | | 6/1999 | Lloyd . | |
| 6,076,472 | | 6/2000 | Lloyd . | |

* cited by examiner

*Primary Examiner*—Alexander Grosz
(74) *Attorney, Agent, or Firm*—Kolisch Hartwell Dickinson McCormack & Heuser

(57) ABSTRACT

The present invention is a folding and telescopic structure that consists of two parallelograms (1) (2), which can be flattened in opposite directions, located on the same plane and joined articulately by two springs (17) from its front (3) and back (4) jambs. These jambs (3) (4), which are "U" shaped and hollow, allow the end (5) and intermediate (6) crossbars to lodge inside to totally occupy the space available inside the hollow jambs. The end crossbar (5) has a groove (8) in which to slide a first shaft (9) of the back jamb (4) at the same time that a it can turn counter-clockwise upon a second shaft (10) of the front jamb (3) . The intermediate crossbar (6) 15 moves in a similar way, but the hinge (13) that receives the second shaft (12) is not fixed on the intermediate crossbar (6), but can be slid across it. FIG. 1.

4 Claims, 2 Drawing Sheets

FOLDING, DISMOUNTABLE AND TELESCOPIC STRUCTURE

This invention is a structure that may be used to cover a relatively extensive area, compared to the size it occupies once it is folded, flattened, and compressed, since some parts fit inside other parts in a telescopic way.

It is useful in the furniture industry to make chairs or beds, and in the home to make washing lines, portable antennae and generally for any application that requires a folded structure with reduced weight and volume to cover a relatively large area.

The folding telescopic structure that is the subject of this invention is formed by two parallelogram structures that flatten when opposed corners move in opposite directions, on the same plane. The two parallelogram structures are joined by two spring hinges, one connecting the front jambs and one connected to the back jambs. The end and intermediate crossbars, are attached to these jambs and fit inside these jambs, which are "U" shaped and hollow, when the folding telescopic structure is folded, flattened, and telescopically compressed completely filling the available space within these jambs.

The advantages compared to other folding devices are considerable, because the structure that is the subject of this invention achieves:

A reduction of 50% in the length of the area, once unfolded.

A reduction of 90% in the width of the area, once unfolded.

When unfolded, the structure automatically cannot be flattened and telescopically compressed.

High resistance.

Minimum volume, once the structure is folded.

In addition to this description, and with a view to a better comprehension of the characteristics of this invention, we provide a detailed description of a representative construction, based on a set of drawings that are attached to, and form part of, this descriptive report, where we have represented, as a purely illustrative example that in no way limits possible uses of the structure, the following.

Figure 1:
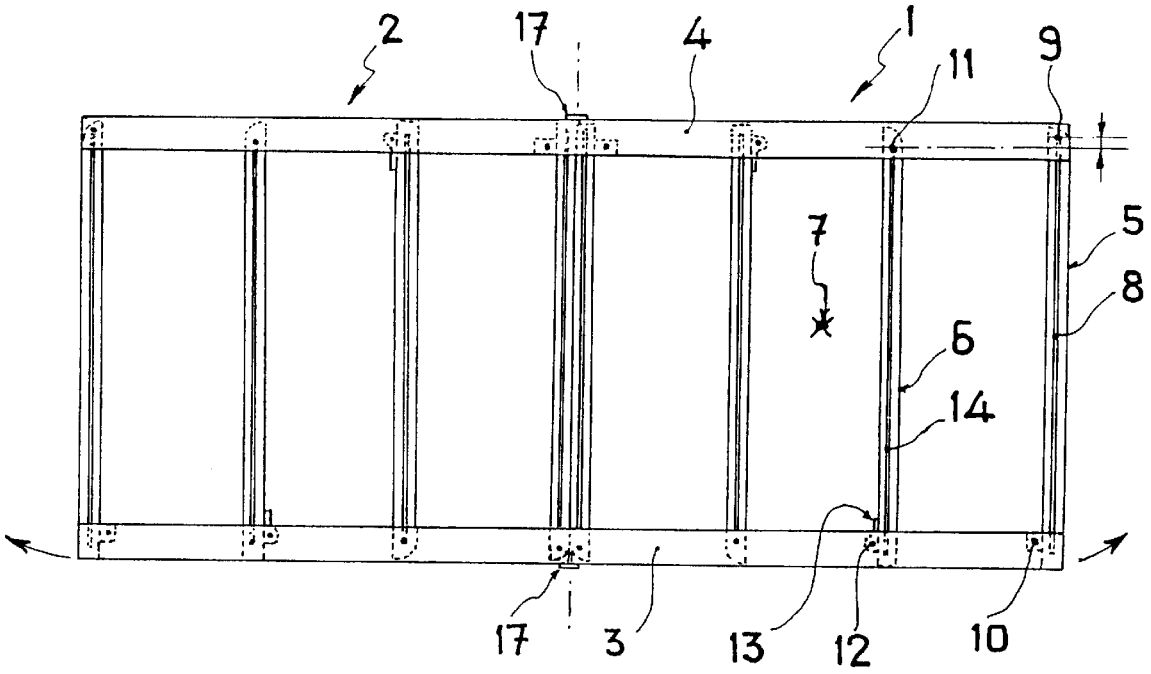
FIG. 1 is a top view of a bed made with the folding telescopic structure that is the subject of this invention.

In these figures, the references correspond to the following elements.

1. Right hand parallelogram structure
2. Left hand parallelogram structure
3. Front hollow jamb
4. Back hollow jamb
5. End crossbar
6. Intermediate crossbar
7. Center of the parallelogram
8. Groove in the end crossbar
9. First shaft, or sliding pin joint of the end crossbar

Figure 2:
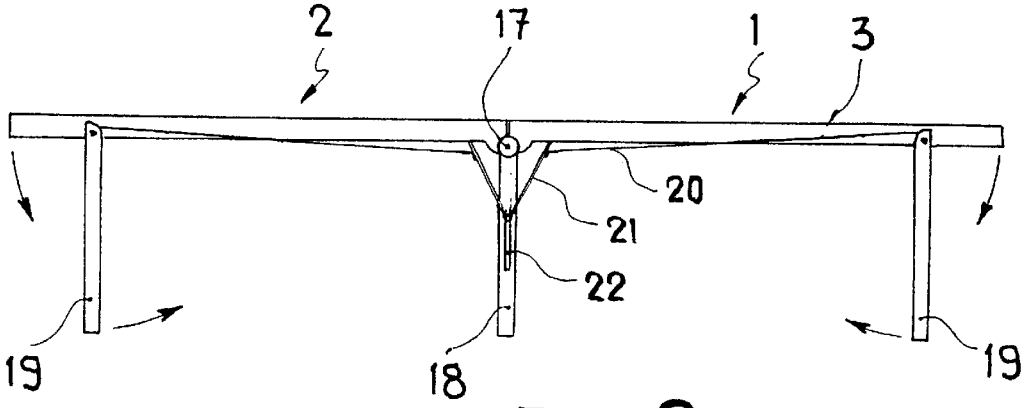
FIG. 2 is a front view of the bed represented in FIG. 1.

10. Second shaft, or hinge pin joint of the end crossbar
11. First shaft, or sliding pin joint of the intermediate crossbar
12. Second shaft, or hinge pin joint of the intermediate crossbar
13. Hinge
14. Main groove in the intermediate crossbar
15. Rivet
16. Secondary groove in the intermediate crossbar
17. Spring hinge joint
18. Central legs
19. Side legs
20. Longitudinal shank
21. Obliquous shank
22. Groove in central leg FIGS. 1 and 2 show the general aspect of a bed made using the folding telescopic structure that is the subject of this invention, and how it consists of two parallelogram structures (1) (2), which first fold one on top of the other and then flatten in parallel by moving opposed corners in opposite directions located on the same horizontal plane. Each of the two parallelogram structures in turn consists of two "U" shaped hollow jambs (3) (4), between which there are four crossbars (5) (6) with main grooves two of the cross bars are end crossbars (5) and two are intermediate crossbars (6), so that the sides of the parallelogram structures (1) are completely symmetrical around its center (7).

The right hand end crossbar (5) has a main groove (8) along its entire length, in which to slide the first shaft, or sliding pin of the back jamb (4).

Figure 6:
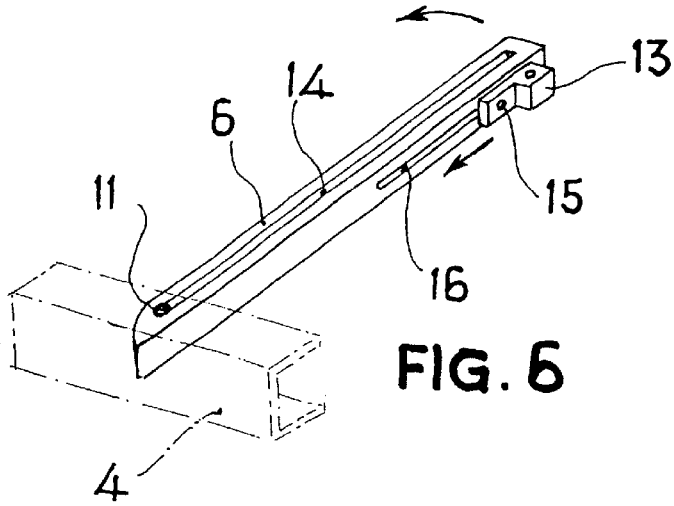
FIG. 6 is an isometric view of an intermediate crossbar in detail, showing the hollow jamb in dashed lines.

This end crossbar (5) can also turn counter-clockwise upon a second shaft, or hinge pin (10) of the front jamb (3) at the same time, the right hand intermediate crossbar (6) has a main groove (14) along its entire length, in which to slide the first or sliding pin shaft (11) of the back jamb (4). This intermediate crossbar (6) can also turn counter-clockwise upon a second or hinge shaft (12) of the front jamb (3). However, unlike the end jamb (5), the hinge (13) that receives the second shaft, or hinge pin (12) is not fixed upon the intermediate crossbar (6) but can slide along it thanks to a rivet (15) that moves inside a secondary groove (16) located perpendicularly to the main groove (14) of the intermediate crossbar (6). (See FIG. 6).

Both parallelogram structures (1) and (2) are joined together thanks to a hinge spring (17) located at each side of the assembly and on the respective jambs (3) (4), which prevents the assembly from being flattened and telescopically compressed when the parallelogram structures (1) (2) are unfolded.

The intermediate crossbars (6) can be replaced by rods parallel to the front (3) and back (4) hollow jambs, or a network of rods and perpendicular crossbars can be installed, by using telescopic tubes of different diameters anchored on scaled arches on the end crossbars (5), so that once the structure is folded, the rods are in the same parallel position as the crossbars.

In the example we have described, which represents a bed, the assembly is completed with two central legs (18) and four side legs (19), the last of which are mounted on the hollow jambs (3) (4).

This operates as follows.

When the bed is folded as shown in FIG. 1, the parallelogram structures(1) (2) could be flattened in the direction indicated by the arrows but this movement is prevented, because the front jambs (3) are joined by the hinge spring (17).

Figure 3:
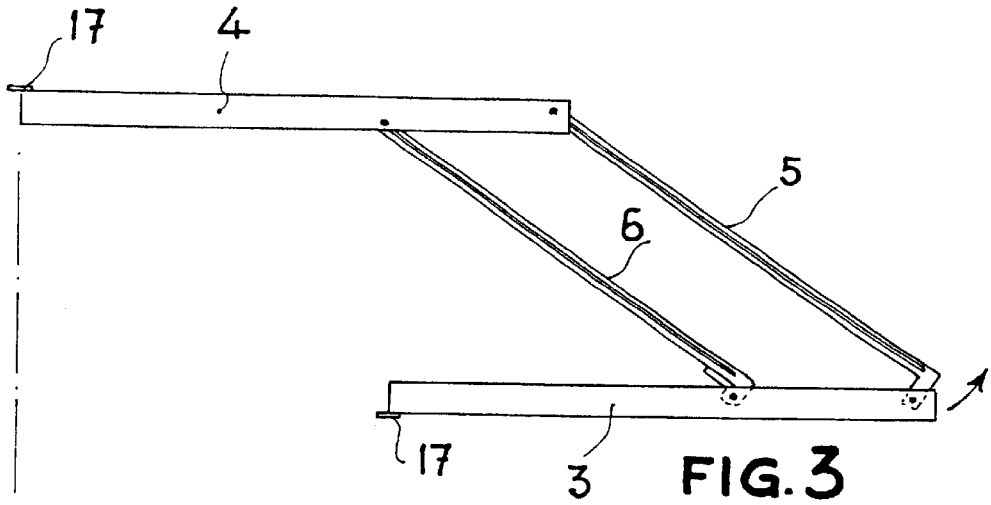
FIG. 3 is a top view of the bed of FIGS. 1 and 2, shown folded and partially flattened, with elements removed for clarity.
Figure 4:
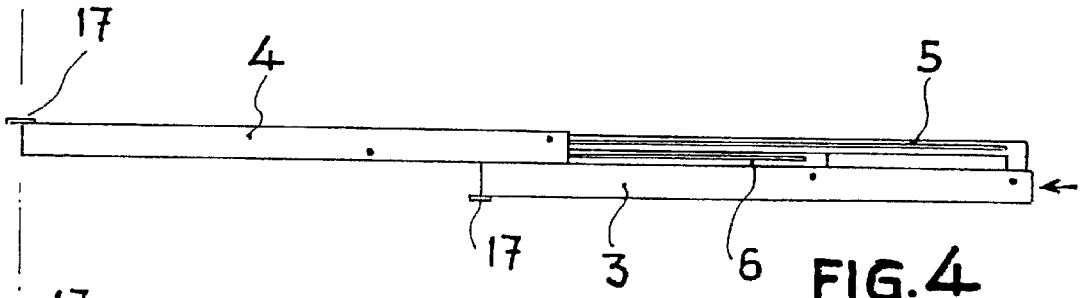
FIG. 4 is a top view of the bed of FIG. 3, shown fully flattened with an arrow indicating a compressing telescopic motion.
Figure 5:
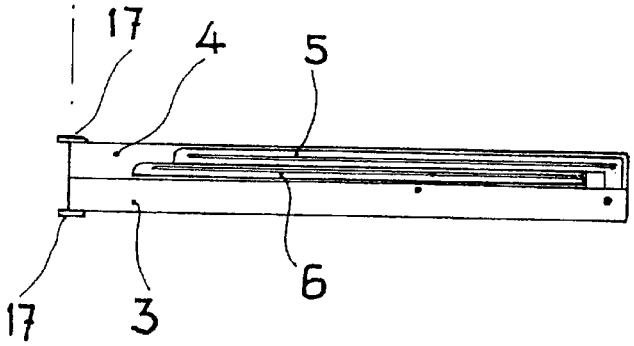
FIG. 5 is a top view of the bed of FIG. 4, after the compressing telescopic operation.

Taking the unfolded bed as represented in FIG. 2, the first operation is to fold downwards the ends of both parallelogram structures (1) (2), as shown by the arrows, at the same time that the side legs (19) are folded inwards turning upon the shafts that join them to the hollow jambs, thanks to the eccentric force of the longitudinal rods (20) which are in turn received from the obliquous, or vertical rods (21) when they slide along the groove in the central leg (22). Once the two parallelogram structures (1) (2) are one on top of the other and their respective hollow jambs are connected by the double spring hinge (17) they can be flattened, by displacing the front hollow jambs (3) from the back hollow jambs (4), as shown by the arrow that appears in FIG. 3. This movement causes opposed corners of the parallelogram structure to move in opposite directions. This movement continues until the front hollow jambs (3) are adjacent to the back jambs (4), as shown in FIG. 4. The final operation consists of telescopically compressing the entire structure, simply displacing laterally the front hollow jambs (3) with regards to the back hollow jambs (4) in the direction of the arrow that appears in FIG. 4 until reaching the final position represented in FIG. 5. So that the sequence followed in FIGS. 3, 4 and 5 is easier to comprehend, we have only represented one end crossbar (5) and one intermediate crossbar (6) which as shown, are hidden inside the back hollow jamb (4), occupying practically all the space available. The crossbars on the left side, which are not represented, will be hidden inside the front hollow jamb (3). It is easily understandable that the ideal materials to be used to make the folding telescopic structure that is the subject of this invention, will be different depending on the final application. For furniture, the use of aluminum will be preferred, together with plastic materials. For antennae, aluminum or metal covered plastic material can be used, whereas for washing lines the ideal material will be a very cheap plastic.

I claim:

1. A folding telescopic apparatus, comprising:

a pair of parallelogram structures formed from spaced apart first and second jambs and a plurality of cross bars extending therebetween; and a pair of hinges connecting the pair of parallelogram structures, wherein the parallelogram structures have an unfolded configuration and a folded configuration, the jambs being fixed in the unfolded configuration and adapted to flatten the parallelogram structure when in the folded configuration by moving opposed comers of the parallelogram structure in opposite directions, and adapted to telescopically compress after the parallelogram structure has been flattened.

2. The apparatus of claim 1, wherein the first and second jambs are hollow "U"-shaped and the parallelogram structure includes:

a pair of end cross bars connecting the first and second jambs, wherein the end cross bars include a pivoting end attached by a hinge pin and a sliding end attached by a sliding pin, wherein the sliding pin is configured to slide along a groove extending the length of the end cross bar; and at least one intermediate cross bar connecting the first and second jambs, wherein the intermediate cross bar includes a pivoting end attached to either of the first and second jamb by a hinge pin, which is mounted to a hinge that slides in an auxiliary groove extending along a portion of the intermediate cross bar, and a sliding end attached by a sliding pin to the other jamb, which is adapted to slide along a main groove extending the length of the intermediate cross bar perpendicular to the auxiliary groove, wherein both the end cross bars and intermediate cross bars are configured to rotate counterclockwise when the parallelogram structure flattens and then slide when the parallelogram structure is telescopically compressed.

3. The apparatus of claim 2, wherein the apparatus is used as a bed and includes:

a pair of central legs joined to the jambs, one leg of the pair attached to each jamb; and two pairs of end legs joined to the jambs, a pair of legs attached at each end of the bed, one leg of each pair attached to each jamb.

4. The apparatus of claim 1, wherein the apparatus is used as a bed and includes:

a pair of central legs joined to the jambs, one leg of the pair attached to each jamb; and two pairs of end legs joined to the jambs, a pair of legs attached at each end of the bed, one leg of each pair attached to each jamb.

* * * * *